US005526327A

United States Patent [19]

Cordova, Jr.

[11] Patent Number: 5,526,327

[45] Date of Patent: Jun. 11, 1996

[54] SPATIAL DISPLACEMENT TIME DISPLAY

[76] Inventor: David J. Cordova, Jr., 113 S. Queen St., Lancaster, Pa. 17603

[21] Appl. No.: 212,968

[22] Filed: Mar. 15, 1994

[51] Int. Cl.[6] ..... G04C 19/00; G04C 17/00; G04B 19/00

[52] U.S. Cl. ..... 368/82; 368/223; 368/239

[58] Field of Search ..... 368/76, 82–84, 368/223, 228, 239–242

[56] References Cited

U.S. PATENT DOCUMENTS

| | | | |
|---|---|---|---|
| 4,030,285 | 6/1977 | Sheth . | |
| 4,077,198 | 3/1978 | Mayenschein | 58/1 |
| 4,094,464 | 6/1978 | Kawamura et al. | 239/17 |
| 4,279,031 | 7/1981 | Dostoomian | 368/82 |
| 4,280,211 | 7/1981 | Meyenschein | 368/76 |
| 4,357,691 | 11/1982 | Goodchild | 368/62 |
| 4,421,415 | 12/1983 | Goldfarb | 368/62 |
| 4,421,419 | 12/1983 | Morishige et al. | 368/73 |
| 4,473,304 | 9/1984 | Ketner | 368/281 |
| 4,692,032 | 9/1987 | Rubin | 368/76 |
| 4,752,919 | 6/1988 | Clark | 368/223 |
| 4,771,409 | 9/1988 | Heeks | 368/11 |
| 4,920,524 | 4/1990 | Kotob | 368/240 |
| 5,008,870 | 4/1991 | Vessa | 368/242 |
| 5,214,624 | 5/1993 | Siebrasse | 368/82 |
| 5,228,013 | 7/1993 | Bik | 368/223 |
| 5,253,228 | 10/1993 | Truett | 368/82 |
| 5,331,609 | 7/1994 | Gubin | 368/223 |

*Primary Examiner*—Vit W. Miska

[57] ABSTRACT

A display and method for depicting the passage of time by selectively and progressively filling predetermined areas, each area representing hours, minutes, seconds and tenths of seconds respectively. The areas may be of any shape or combination of shapes. The portion of the area that is filled represents that portion of an hour, minute, second or tenth of second that has passed. The areas may be normally dark in which case filling illuminates the area. Areas may be normally light in which case filling darkens the area. The areas may be any visually perceptible medium capable of changing light intensity or color including discharge tubes, light emitting diodes, liquid crystal displays, fiber optic bundles, or hologram images. The areas may be arranged in unconventional and discontinuous patterns and incorporated into a wide variety of objects.

21 Claims, 8 Drawing Sheets

SPATIAL DISPLACEMENT TIME DISPLAY

BACKGROUND

Display of the time of day is conventionally done by either direct display of numerals and letters or by means of rotating hands that point to numerals on a circular display, or by some combination thereof. Although the basic time displays have been in use for many years, a few alternative methods for displaying time have appeared.

For example, an alternative time display is described in U.S. Pat. No. 4,094,464, wherein time is displayed by a three dimensional water fountain device controlled by a matrix of programmable controlled electromagnetic valves.

Another alternative time display is described in U.S. Pat. No. 4,280,211 wherein time is displayed through a series of window-like apertures. The apertures are arranged in a time related indicia. The placement order of spheroids as viewed through the apertures is changed thus providing a time readout. The apertures may be horizontally aligned or vertically stacked.

Yet another alternative time display is described in U.S. Pat. No. 4,357,691. In this display, a rectangular-faced clock is provided wherein the passage of time is indicated by the intersection of horizontal and vertical lines that move across the clock face.

U.S. Pat. No. 4,421,415 discloses a clock mechanism that displays time by the accumulation of counting tokens within zigzag shaped channels. Tokens are fed into the top of unfilled channels. When a channel is full, the token does not feed into that channel but passes into another channel and causes the tokens in the already full channel to release.

Another mechanism is that of U.S. Pat. No. 4,077,198 wherein moveable spheroids pass through a series of pivotable spheroid holder members. The spheroids are loaded and unloaded on the pivotable members but are positioned with respect to time related indicia on the spheroid holders.

Some of these alternative time displays require placement of some type of object upon a carrier. The objects may be spheroids or tokens which are used to sequentially fill slots or carriers. The carriers or slots are marked with time related indicia to facilitate time awareness. Although initially interesting, these displays have found little commercial success. Moreover, it would be desirable to display time electronically in a manner that is more in keeping with modern electronic society.

Most of today's time displays are limited to a conventional dial/hand arrangement or a digital display. The only difference between clock designs is that the display is mounted or superimposed upon some other object. It would be desirable to provide clock designers with a broader range of imaginative designs from which to choose. It is an object of the present invention to provide time display means whereby the available range of clock design may be extended by incorporating the time display into a wide variety of shapes. Another object of the present invention is to provide a time display that does not employ electronic or mechanical hands or arms and whereby the time is not displayed by a direct digital readout.

At a young age, humans show fascination by motion, colors, lights, and colored lights in motion. Entertainers have supplemented their acts with visual effects embodying moving colored lights. Dance halls feature elaborate strobe light systems. Arcades are designed with moving light displays. Conventional time display runs counter to the human fascination with colored lights and motion. Conventional time display is in slow motion and with no colors. Conventional time display is all function and allows little artistic creativity. What is needed is a time display that can include colored lights and fast motion and yet remain capable of providing timing information to the visual perceiver. A further object of this invention is to display time in a spectacular entertaining and intriguing manner.

Children are particularly susceptible to flashing lights and fast motion. Children also have their own particular likes and dislikes as to toys, games, and heroes. Still another object of this invention is to provide means for incorporating time display into child oriented objects such as toys, games, popular persona, and cartoon characters.

Telling time by reading digital numbers or the position of hands on a conventional clock or watch becomes virtually automatic. Little conscious thought is exerted when telling time conventionally. In order to exercise the mind, yet another object of this invention is to display time in a manner that requires the time display reader to think in order to calculate the time.

For the foregoing reasons, there is a need for a time display that is suitable for placement on a wide variety of objects; that can be displayed by moving colors; and that embodies a display that makes the observer think when telling time.

SUMMARY

The present invention is directed toward a method and apparatus for displaying time that satisfies the need for a time display method and apparatus that is suitable for placement or incorporation into a wide variety of objects, can be displayed by moving colors and lights, and that stimulates an observers mental facilities when telling time. Time is displayed by lighting, coloring, or otherwise filling areas that represent hours and minutes. If desired, areas that represent seconds and tenths of seconds may be included in the display. The areas need not be any particular shape and need not be arranged contiguous to each other.

The passage of one minute is represented by incrementally and progressively filling a seconds area during an elapsed time of sixty seconds. As the seconds pass, an increasingly larger portion of the seconds area is lighted, colored, or otherwise filled. After sixty seconds, the entire seconds area is filled. After being filled, the seconds area is suddenly returned to its unlit or cleared state. The filling and clearing process is repeated each passing minute.

The passage of one hour is represented by incrementally and progressively filling a minutes area during an elapsed time of sixty minutes. As the minutes pass, an increasing larger portion of the minutes area is lighted, colored, or otherwise filled. After sixty minutes, the entire minutes area is filled. After being filled, the minutes area is suddenly returned to its unlit or cleared state. The filling and clearing process is repeated each passing hour.

The passage of hours is similarly represented by filling and clearing the hours area. If the clock is a twelve hour clock, the hours area is incrementally and progressively filled during a twelve hour period. If the clock is a twenty four hour clock, the hours area is filled during an elapsed time of twenty four hours. After filling is complete, the hours area is suddenly cleared and the process repeated.

If desired, an area depicting the passage of tenths of seconds may be added to the display. As each tenth of a second passes, the tenths area is incrementally and progressively lighted, colored, or otherwise filled. In one second, the tenths area becomes filled and suddenly cleared. The process is repeated with every passing tenth of a second.

In a normally darkened timing area, filling and clearing is accomplished by incrementally and progressively illuminating the timing area and then suddenly darkening the timing area. However, timing areas may also be normally illuminated. In a normally illuminated timing area, filling begins with a fully illuminated area and occurs by incrementally and progressively darkening the timing area until it is fully non-illuminated. In this situation, clearing occurs when the timing area is suddenly fully illuminated again.

The timing areas are constructed of any media which permits an observer to perceive the progressive filling of the area. For example, in one embodiment, the areas are constructed of an array of light emitting diodes. A multicolored effect is achieved by making the hours, minutes, and seconds areas of different colored LED's. The areas can also be constructed of liquid crystal displays, the ends of a bundle of fiber optic elements, discharge tubes, incandescent lights or laser projected hologram images.

For single plane displays, the timing areas may be of any shape. Geometric shapes such as squares, rectangles, triangles, pentagons, hexagons, circles, rings, or ovals may be used. However, timing areas need not be geometric shapes and can be any irregular shape having an exterior perimeter. Areas may be filled from any direction.

Utilization of timing areas instead of conventional mechanisms and displays allows the time display to be incorporated into a wide variety of child oriented objects. An imaginative designer may incorporate timing areas into two or three dimensional child oriented objects such as teddy bears, ice cream cones, footballs, hearts, and toy trucks.

Light sources from which the timing areas may be constructed are light emitting diodes, liquid crystal displays, fiber optic bundles, discharge tubes, laser projected hologram images, or incandescent lights. In the case of some larger displays constructed of discharge tubes that cannot be rapidly turned on or off, it may be desirable to place moveable shutters over the light source. The shutters may then be incrementally opened or closed by motor means controlled by a timing and power circuit.

The displays are controlled by a timing and power circuits that provide the time keeping function and the electrical signals that illuminate and darken the timing areas that represent elapsed time.

This method for displaying time comprises the steps of filling a seconds area during an elapsed time of one minute. The seconds area is suddenly cleared. The seconds area repeatedly fills and clears every minute in this manner as time advances. The minutes area is filled during an elapsed time of one hour. After the passage of one hour, the minutes area is cleared. The minutes area repeatedly fills and clears every hour while the display is in operation. The hours area is filled during an elapsed time of twelve hours. After the passage of twelve hours, the hours area is cleared. The hours area repeatedly fills and clears every twelve hours while the display is in operation. The hours display can also be configured as a twenty four hour clock in which case the hours area fills and clears every twenty four hours.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
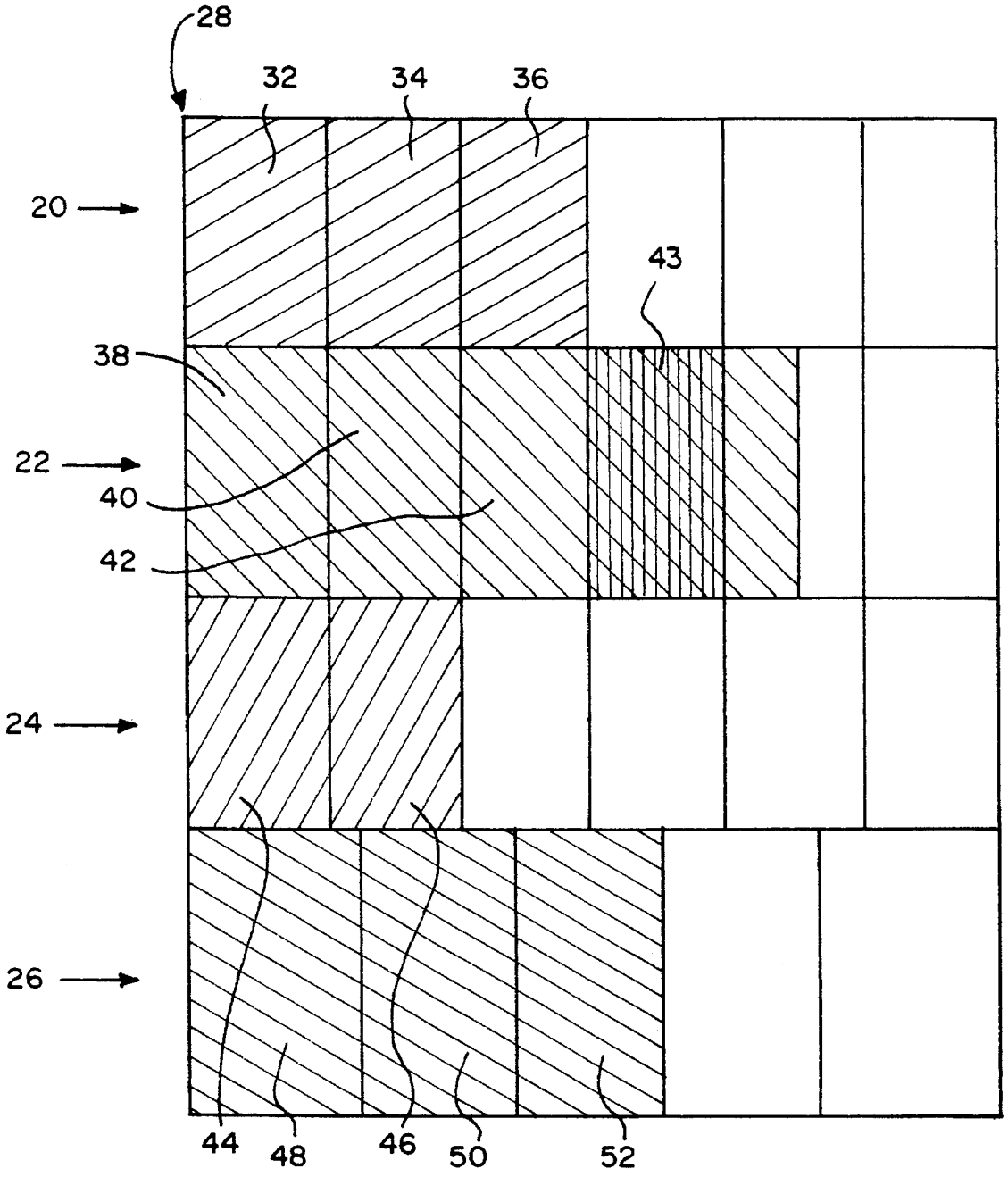
FIG. 1 is a spatial displacement time display wherein the display comprises parallel contiguous timing bars.

FIG. 1 illustrates a basic spatial displacement time display having four horizontal parallel contiguous timing areas, each timing area or timing bar being rectangularly shaped. The display is arranged so that hours bar 20, minutes bar 22, seconds bar 24, and tenths of seconds bar 26 start, at a beginning datum 28, on the left side of the display. The length of the hours, minutes, seconds bars are equal and marked into smaller segments for convenience in reading the display. Segment 32 on hours bar 20 is one of six horizontal hours segments, each segment representing a time of two hours. As time progresses from the starting or reference time, the left most horizontal segment, segment 32 is incrementally and progressively filled in a rightwardly direction until, after two hours, segment 32 of hours bar 20 is filled. During the third and fourth hours, segment 34 is incrementally and progressively filled. In FIG. 1, the shaded areas represent filled areas: the unshaded areas represent unfilled areas. Thus the shaded areas in FIG. 1 show segments 32, 34, and 36 of hours bar 20 filled after six hours. In a twelve hour display, all segments of hours bar 20 are filled after an elapsed time of twelve hours. After hours bar 20 is filled, hours bar 20 is suddenly cleared and the filling and clearing process repeats itself in the next twelve hour period.

The filling process proceeds incrementally and progressively from left to right in incremental time steps. The duration of each time step on hours bar 20 may be one hour or whatever lesser increment is desired by the designer. For example, a time step of one hour results in the hours segments being half filled to their horizontal mid points on odd numbered hours and being completely filled at even numbered hours.

In FIG. 1, minutes bar 22 is arranged to be the same width and length as hours bar 20. Minutes bar 22 is incrementally and progressively filled from left to right in the same manner as hours bar 20 except that when minutes bar 22 is completely filled, an elapsed time of 60 minutes is represented. Filling horizontal segments 38, 40, and 42 of minutes bar 22 represents 30 minutes. FIG. 1 shows minutes bar 22 being three quarters filled at a time interval of 45 minutes. After minutes bar 22 is completely filled, further progression of time suddenly clears minutes bar 22 and the filling and clearing process is repeated in each passing hour.

In minutes bar 22, each horizontal segment can be further subdivided into individual one minute segments 43. If ten minute segments such as segments 38, 40 and 42 are subdivided into one minute segments, minutes bar 22 can effectively be divided into 60 one minute areas. Filling a single one minute area with the passage of each minute provides a smooth fill to minutes bar 22.

Seconds bar 24 is also divided into six horizontal segments which are incrementally filled, left to right, as the seconds increment. At fifteen seconds after the base time, seconds bar 24 is one quarter full; at thirty seconds bar 24 is one half full; at forty five seconds bar 24 is three quarters full, and at sixty seconds bar 24 is completely filled. FIG. 1 shows seconds segments 44 and 46 being filled. This represents a time of one third of a minute or twenty seconds after the minute. After seconds bar 24 is completely filled, further progression of time suddenly clears seconds bar 24 and minutes bar 22 is incremented by one minute.

Tenths of seconds bar 26 is shown in FIG. 1 with five horizontal segments. Alternatively, tenths bar 26 may be subdivided into ten segments. The segments of tenths bar 26 are incrementally and progressively filled, left to right, as the tenths of seconds pass. At two tenths of a second after the base time, tenths bar has segment 48 filled; at six tenths of a second after the base time, tenths bar has segments 48, 50, and 52 filled and is three fifth or six tenths full; after one second, tenths bar 26 becomes completely filled. After tenths bar 26 is completely filled, further progression of time clears tenths bar 26 and increments seconds bar 24 by one second.

It is not necessary to segment the bars but bar segmentation facilitates time reading and computation for a viewer first encountering the spatial displacement display. In a twelve hour time display, hours bar 20 may typically be segmented into 12 units. In a twenty four hour time display, hours bar 20 may be segmented into 24 units. Minutes bar 22, and seconds bar 24 are more typically segmented into 12 units so that the viewer may mentally correlate the spatial displacement time display to the clock face with which he is already familiar. However, to illustrate the spatial displacement time display without a confusing plurality of segments, FIG. 1 shows segmentation of minutes bar 22 and seconds bar 24 into six units.

Figure 2:
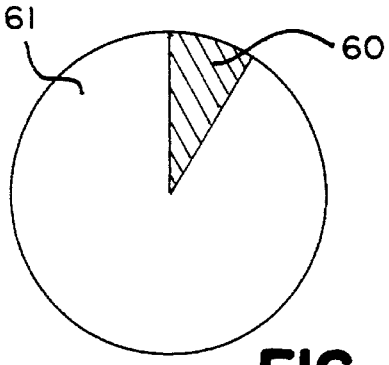
FIG. 2 is a circular area filled in a circumferential direction.

FIG. 2 illustrates a circular timing area that is filled by gradually increasing the angular displacement of filled area 60 until the entire circular area is filled. Increasing the angular displacement of filled area 60 can be done in a clockwise direction, in a counterclockwise direction, or in both directions at the same time. As time passes, filled area 60 becomes progressively larger while unfilled segment 61 becomes progressively smaller. When the circle is completely filled, filled area 60 occupies the entire circle and unfilled segment 61 is non-existent. When the circular area is suddenly cleared, unfilled segment 61 occupies the entire circular area and filled area 60 becomes non-existent. As the filling process is repeated, filled area 60 again becomes progressively larger as unfilled area 61 becomes smaller. If FIG. 2 represents a minutes area, filling the circle takes place progressively and incrementally during the passage of 60 minutes.

Figure 3A:
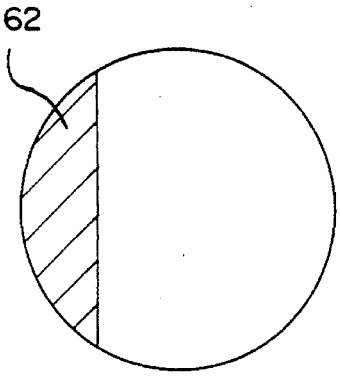
FIG. 3*a* is a circular area one quarter filled across a horizontally disposed diameter.
Figure 3B:
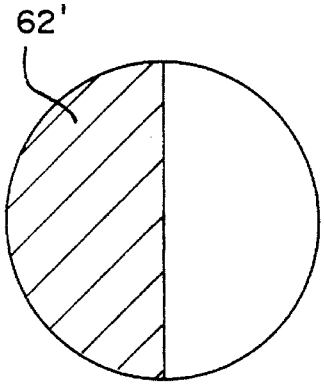
FIG. 3*b* is a circular area one half filled across a horizontally disposed diameter.
Figure 3C:
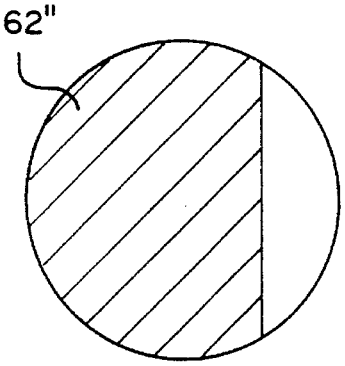
FIG. 3*c* is a circular area three quarter filled across a horizontally disposed diameter.

An alternative method for filling a circular timing area is illustrated in FIG. 3*a*, 3*b*, and 3*c*. In FIG. 3*a*, filled area 62 is a shaded vertical chord segment extending one fourth of the distance across the circular diameter. This represents an elapsed time of one fourth of the full scale of the timing area. If the circular timing area is a minutes area, FIG. 3*a* represents the passage of 15 minutes. FIG. 3*b* shows filled area 62' now extending one half of the way across the diameter, representing passage of one half a time unit. If FIG. 3*b* represents a minutes area, 30 minutes have elapsed. FIG. 3*c* shows filled area 62" extending three quarters across the diameter of the timing circle. If FIG. 3*c* represents a minutes area, 45 minutes have elapsed.

Figure 4:
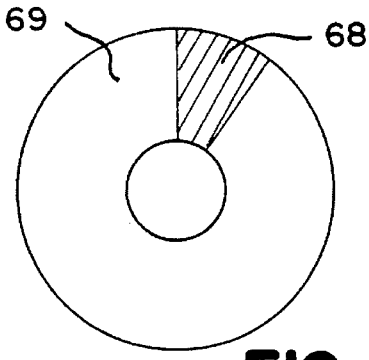
FIG. 4 is a ring shaped area filled in a circumferential direction.

FIG. 4 illustrates a ring shaped timing area that is filled by gradually increasing the angular displacement of filled area 68 at the expense of unfilled area 69 until the entire ring area is filled. Increasing the angular displacement of filled area 68 can be done in a clockwise direction, in a counterclockwise direction, or in both directions at the same time. As filled area 68 becomes larger, unfilled segment 69 becomes progressively smaller. When the ring is completely filled, unfilled segment 69 becomes non-existent. When the entire ring shaped area is then cleared, unfilled segment 69 is the entire ring area and filled segment 68 becomes temporarily non-existent. If FIG. 4 represents a seconds area, filling the ring takes place incrementally during the passage of 60 seconds.

Figure 5A:
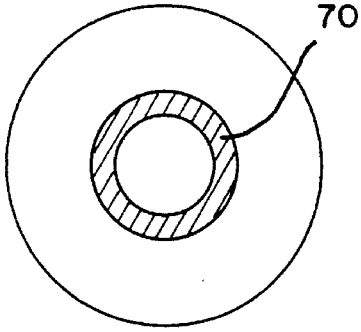
FIG. 5*a* is a ring shaped area one quarter filled in an outwardly radial direction.
Figure 5B:
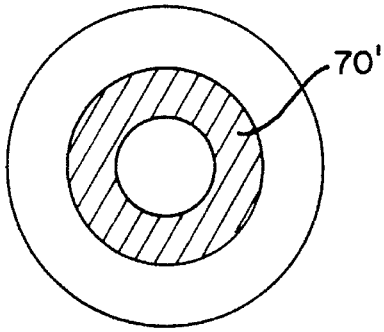
FIG. 5*b* is a ring shaped area one half filled in an outwardly radial direction.
Figure 5C:
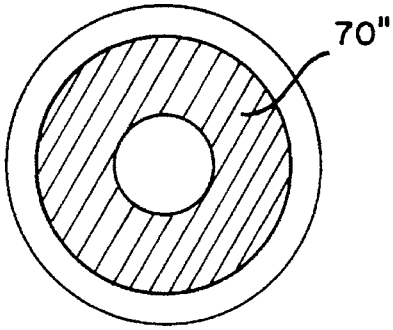
FIG. 5*c* is a ring shaped area three quarter filled in an outwardly radial direction.

An alternative radial fill method for filling a ring shaped timing area is represented in FIGS. 5*a*, 5*b*, and 5*c*. In FIG. 5*a*, filled area 70 is shaded, originating at the rings inside diameter, and extending one fourth of the distance between the distance between the inner and outer diameters of the ring. This represents an elapsed time of about one fourth of the full scale of the timing area. If this timing area is a seconds area, FIG. 5*a* represents the passage of 15 seconds. FIG. 5*b* shows filled area 70' extending to one half of the radial difference between the outer and inner diameters. If FIG. 5*b* represents a seconds area, 30 seconds have elapsed. FIG. 5*c* shows filled area 70" extending three quarters of the radial distance between the outer and inner diameters. If FIG. 5*c* represents a seconds area, 45 seconds have elapsed.

FIG. 3*a* though 3*c* illustrate linear filling of a circle. FIG. 5*a* through 5*c* illustrate radial filling of a ring. However, rings may be linearly filled and circles may be radially filled. Linear filling may be done from any direction. Similarly, radially filling may progress from the outer diameter in an inwardly direction.

The filled areas need not proportionally represent time. For example, in FIG. 3*a* through 3*c*, timing is a function of the linear distance travelled across the diameter and although the chord in FIG. 3*a* had progressed one quarter of the distance across the diameter, the actual mathematical filled area is significantly less than one quarter of the mathematical area of the entire circle. Similarly, in FIG. 5*a*, filled area 70 represents one quarter of a time unit even though the mathematical area encompassed by area 70 is significantly less than one quarter of the total area bounded by the outside and inside diameter of the ring.

Figure 6:
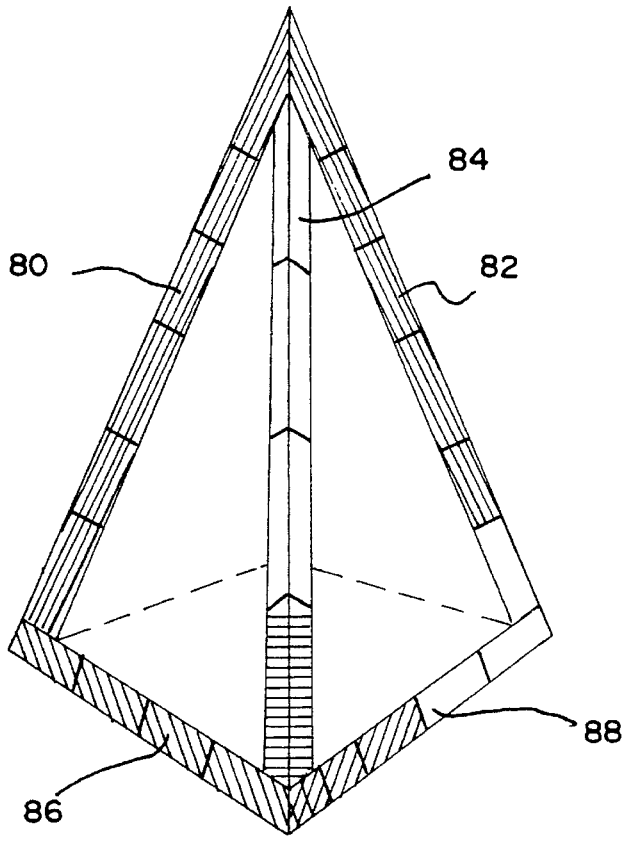
FIG. 6 is a spatial displacement time display wherein the timing bars are arranged in a three dimensional pyramid.
Figure 7:
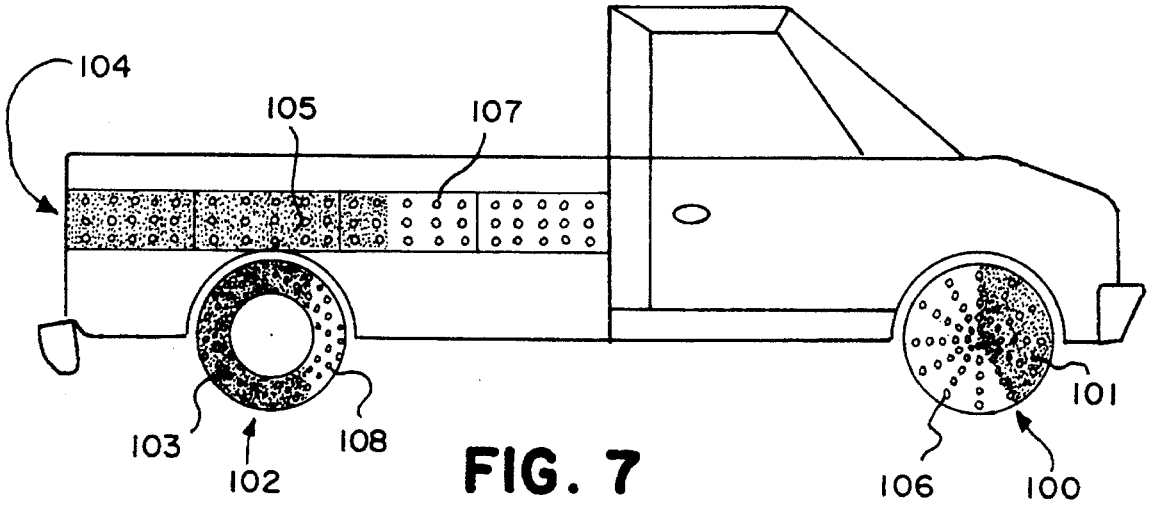
FIG. 7 is a spatial displacement time display wherein the timing area are arranged as part of a truck.
Figure 8:
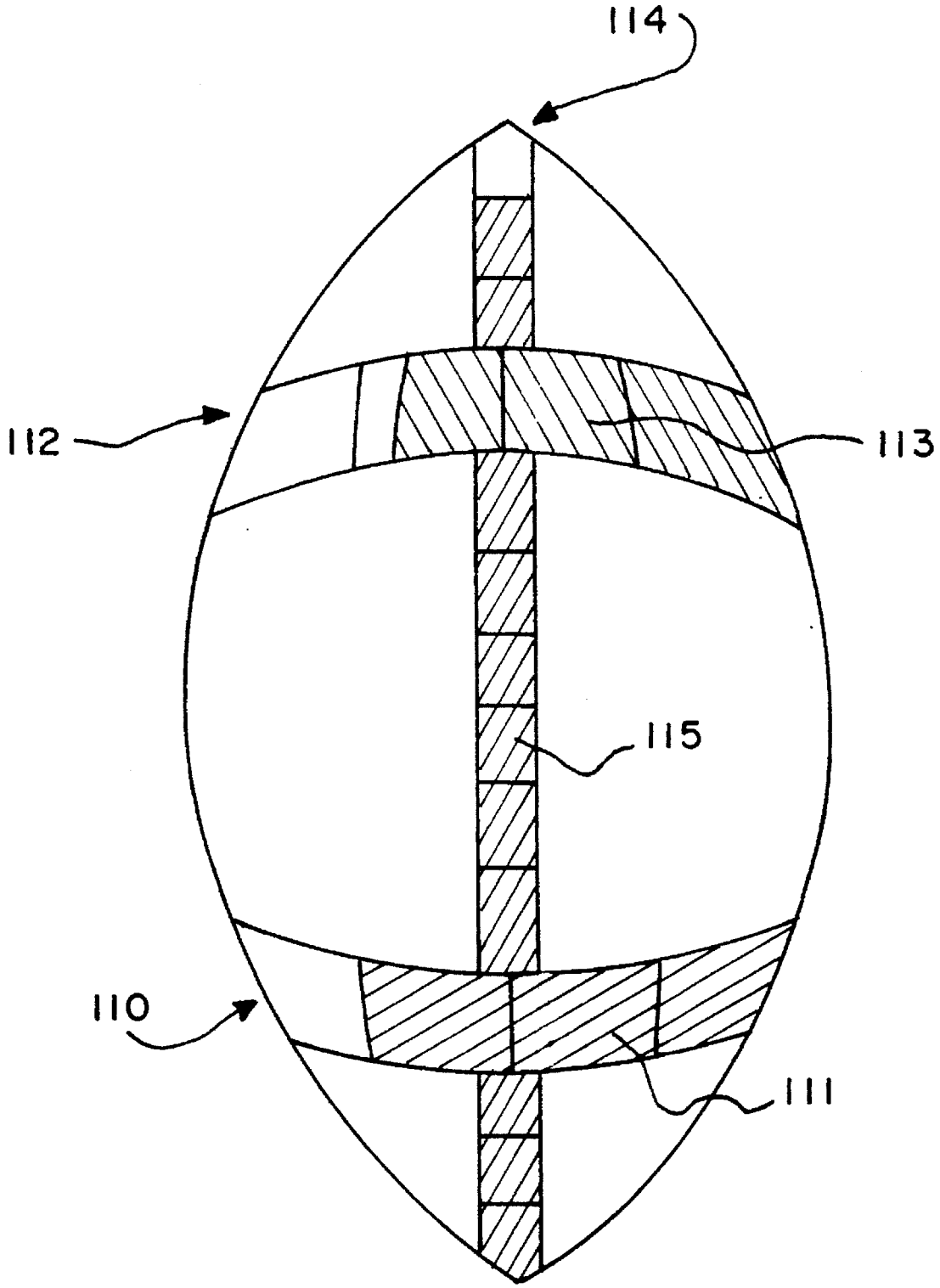
FIG. 8 is a spatial displacement time display wherein timing bars are arranged on a football.

Examples of the manner in which this method of telling time may be incorporated into objects is illustrated in FIG. 6–8. FIG. 6 is a simple tetrahedron in which timing bars have been incorporated into selected edges. Hours bars 86 and 88 are aggregated to produce the hours area. The shaded area represents the filled area which is ¾ of the area of the aggregated hours area thus representing nine hours. Minutes are represented by minutes bar 84. The shaded area in minutes bar 84 is ¼ of the area of minutes bar 84 thus representing fifteen minutes. Seconds bars 80 and 84 are aggregated to produce the seconds area. The shaded area of aggregated seconds bar represents the filled area which is 11/12 of the area of the aggregated seconds area thus representing fifty five seconds.

FIG. 7 illustrates how timing areas may be incorporated into a truck design. The timing areas are illuminated by arrays of light emitting diodes driven by a later described timing power circuit. Front wheel 100 represents an hours timing area, body panel 104 represents a minutes timing area and rear wheel 102 represents a seconds timing area. Front wheel 100 is a circular timing area, consisting of 48 light emitting diodes. The diodes are mounted in sets of four, each set aligned with one of twelve radial lines emanating from the center of front wheel 100. This arrangement is chosen so with each passing hour, four more diodes illuminate. If desired, the array can be mounted on a printed circuit board using surface mount light emitting diodes. Front wheel 100 is a circumferentially filled circular timing area. The base datum for the circumferential fill is in the vertical direction. The diodes in filled area 101 are illuminated. These diodes, as shown, represent 5/12 of the area of front wheel 100 thus representing five hours.

Body panel 104 is a minutes area extending from the rear of the truck to the rear of the truck cab with the datum at the rear of the truck. Body panel 104 is a rectangular timing area comprising an array of 60 light emitting diodes 107. The reference datum for panel 104 is the rear of the truck. The area defined by illuminated diodes is that of area 105. Illuminated area 105 represents 12/20 of the area of body panel 104 thus denoting passage of thirty six minutes.

Rear tire 102 represents a seconds area. Rear tire 102 is a ring area, similar to FIGS. 5*a*–5*c*, except that filling this ring area is accomplished by incrementally and progressively linearly filling the ring across a horizontal diameter in a rearwardly to forwardly direction. An array of 60 light emitting diodes comprises rear tire 102. The area of rear tire 102 defined by illuminated diodes is that shaded area 103. Illuminated light emitting diodes extend across ¾ of the outside diameter of rear tire 102 thus representing 45 seconds.

FIG. 8 is a football shaped display having hours area 110, minutes area 112, and seconds area 114. Seconds area 114 is aligned with the lace placement in a conventional football. Hours area 110 has the shaded filled area 111 extending leftwardly from a base datum on the right side of the football. Shaded area 111 of hours area 110 represents a filled area extending across ¾ of the area of hours area 110 thus representing 9 elapsed hours. Minutes area 112 has its shaded filled area 113 extending leftwardly from the base datum on the right side of the football. Shaded area 113 represents a filled area extending across 8/12 of the area of minutes area 112 thus representing 40 minutes. Seconds area 114 is displayed along the footballs lace line. Shaded area 115 of seconds area 114 represents a filled area extending from a bottom datum in a vertical direction for 11/12 of the area of seconds area 114. The filled shaded area 115 of seconds area 114 represents 11/12 of a minute or 55 seconds.

Timing bars or timing areas are constructed from light sources in a manner that allows the timing areas to be incrementally and progressively illuminated and then rapidly returned to a non-illuminated state. Light sources may be light emitting diodes, liquid crystal displays, incandescent lights, fluorescent lights, neon lights, mercury vapor lights, sodium vapor lights, or any other source of light. In the preferred embodiment, the light sources are light emitting diodes. The LED display comprises arrays of light emitting diodes with the hours, minutes, and seconds areas being constructed of different colored LED's.

A bundle of fiber optic elements may be used to direct light from the light source to the timing area. One end of the fiber optic elements are arranged into a timing area. The other end of the fiber optic element is directed toward a light source capable of incremental and progressive illumination. Fiber optic elements may be useful in fashioning timing areas of irregular shapes. The small size of fiber optic elements would allow intricate designs to be incorporated into a spatial time display.

Timing areas may also be constructed from liquid crystal displays. Readily available LCD's allow successive elements in a row to be activated. These LCD's could be grouped and arranged to provide timing areas. For higher volume application, custom made LCD's could be fabricated that would provide limitless design freedom.

Larger displays may be illuminated by various types of discharge tubes, such as fluorescent tubes, neon lights, sodium vapor, or mercury vapor lights. Large displays incorporating tubes and lamps that cannot be suddenly illuminated and darkened may require means to quickly darken or lighten the display surface. For example, shutters and a shuttering mechanism could be devised that would allow a progressive and incremental opening of the shutters followed by a rapid closing of the shutters. The shutters would be placed on the surface of the spatial displacement time display and would regulate the amount of visible light emanating from the display. Mercury or Sodium vapor lights behind the display would serve as the light source and remain constantly in a lighted condition.

Multiplex holograms create the illusion of a three dimensional object. Hologram images of spatial displacement time displays could be projected by computer controlled laser projection means. This would enable the observer to view a three dimension image of the time display.

A power circuit illuminates and darkens the timing areas. A timing circuit provides information to the power circuit as to when to illuminate and darken the timing areas. In the preferred embodiment, the power circuit and timing circuit are combined into a timing power circuit better seen in FIG. 9. The timing power circuit of FIG. 9 utilizes an integrated circuit clock generator to provide timing information to a group of integrated circuits that count timing pulses and power the timing areas. The timing areas are arrays of light emitting diodes.

Figure 9:
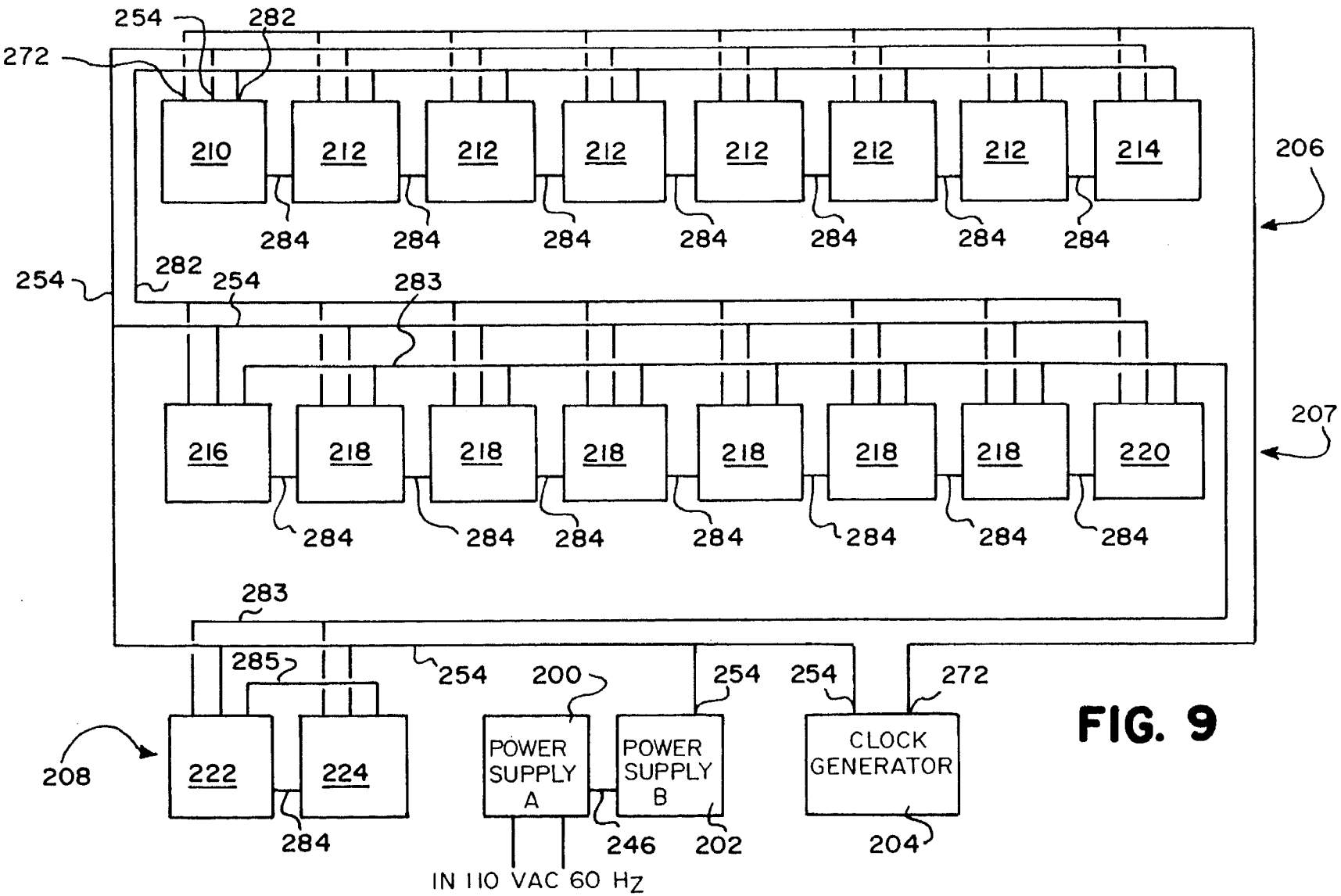
FIG. 9 is an electrical block diagram of a circuit for driving a 12 hour light emitting diode display.
Figure 10A:
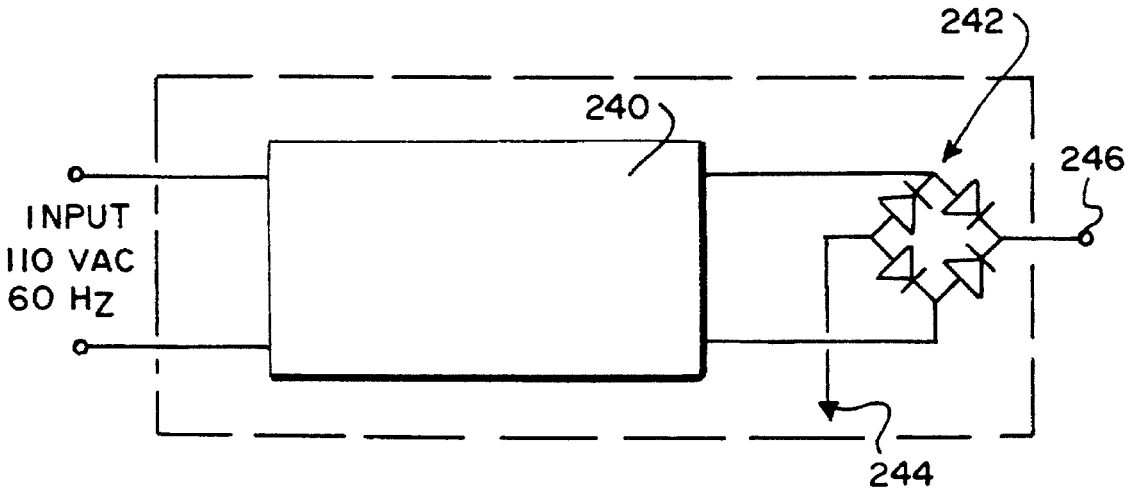
FIG. 10*a* is an electrical schematic diagram of power supply/A.
Figure 10B:
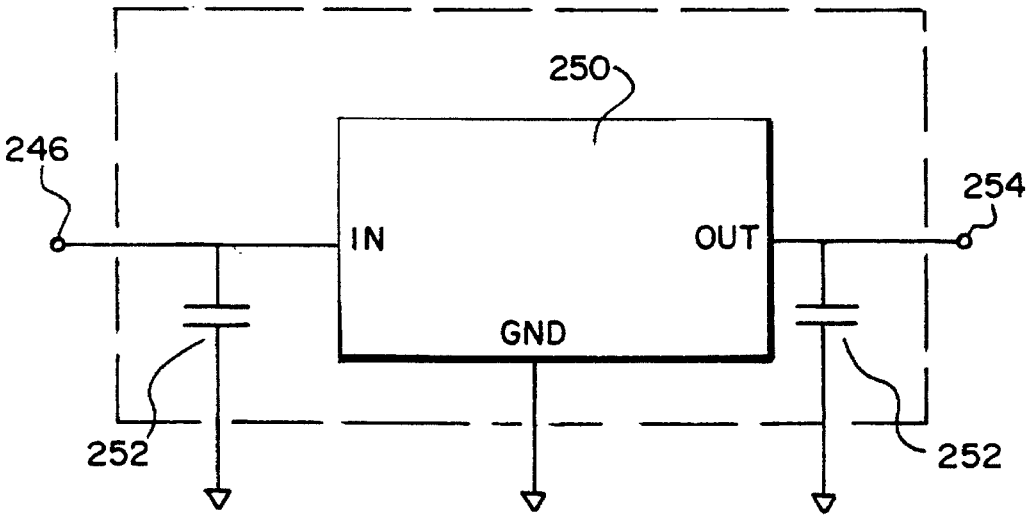
FIG. 10*b* is an electrical schematic diagram of power supply/B.

As better seen in FIG. 10*a*, power supply 200 of FIG. 9 is transformer 240 that provides an output voltage for full wave bridge rectifier 242. Transformer 240 has a 110 volt input and a 7 volt output. Full wave bridge rectifier 242 rectifies the 7 VAC signal into a suitable input for power supply 202. Power supply 202 of FIG. 10*a*, better seen in FIG. 10*b*, comprises integrated circuit 250 with capacitors 252 connected to the input and output terminals and leading to ground. Integrated circuit 250 is a type uA 7805 integrated circuit. Capacitors 252 are 1000 uF capacitors rated higher than 25 volts. The 5 VCC output of power supply 202 at terminal 254 provides power to the remainder of the timing power circuit.

Figure 10C:
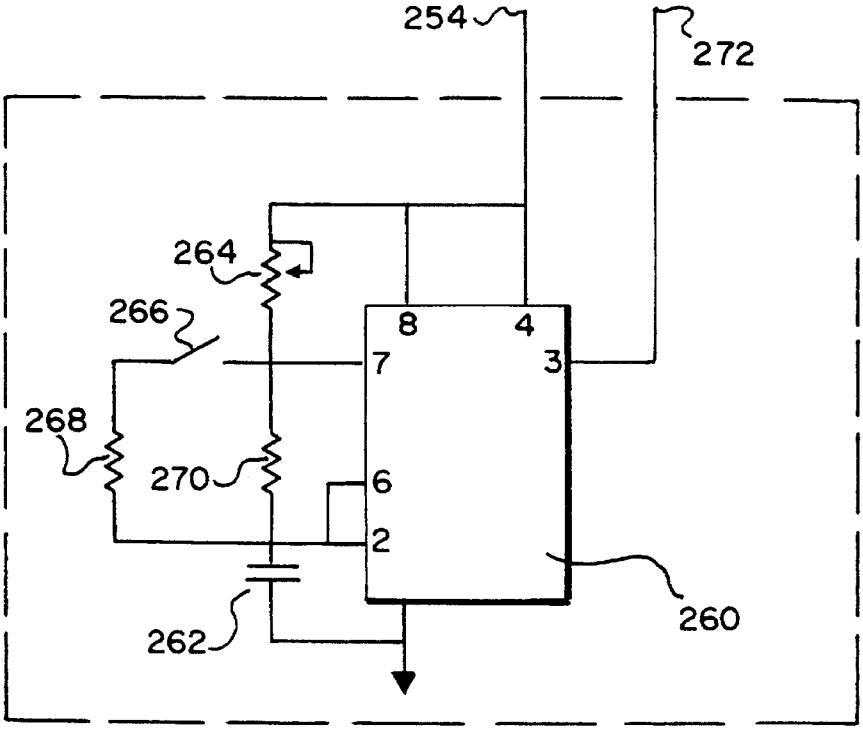
FIG. 10*c* is an electrical schematic diagram of the clock generator.

In the block diagram of FIG. 9, clock generator 204 provides timing pulses to seconds circuits 206. Referring to FIG. 10*c*, clock generator 204 is a type 555 integrated circuit 260. Pin 4 of integrated circuit 260 is connected to terminal 254 of power supply 202 and provides 5 VCC power to integrated circuit 260. One lead of trimmer resistor 264 is connected to pins 4 and 8 of integrated circuit 260. The other lead of trimmer resistor 264 is connected to resistor 270 and thence to capacitor 262. The remaining lead of capacitor 262 is connected to pin 1 of integrated circuit 260 and to ground. Pin 7 of integrated circuit 260 is connected to normally open switch 266. When switch 266 is closed, the clock pulse frequency is greatly increased thus facilitating setting the correct time. The other side of switch 266 is connected through resistor 268 to pins 2 and 6 of integrated circuit 260. The timing pulses emanate from pin 3 of integrated circuit and are directed to seconds circuits 206.

As seen in FIG. 9, circuits 210, 212 and 214 comprise the seconds circuit 206 and provide the signal voltages for driving the seconds area of the LED display. Circuits 216, 218, and 220 comprise the minutes circuit 207 and provide the signalling voltages for driving the minutes area of the LED display. Circuits 222 and 224 comprise the hours circuit 208 and provide the signalling voltages for driving the hours area of an LED display.

Figure 10D:
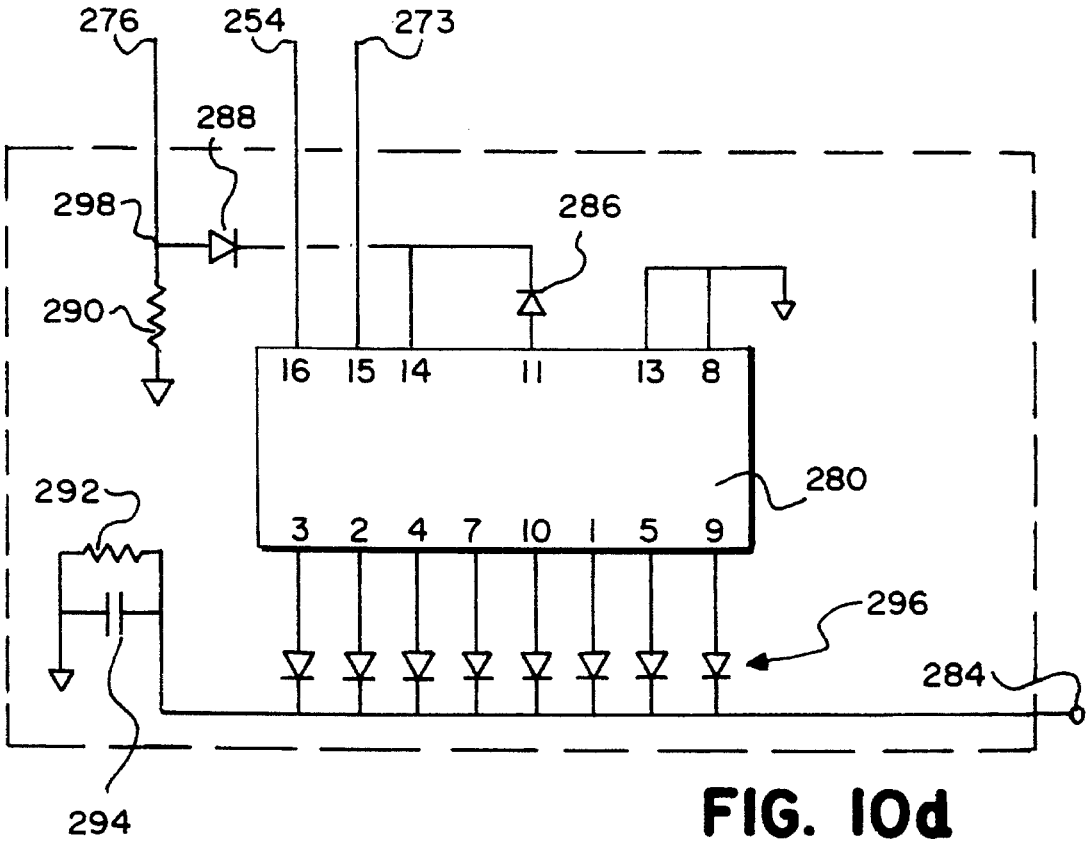
FIG. 10*d* is an electrical schematic diagram showing a block of eight LED's being driven by an integrated circuit.

Circuits 210, 216, and 222 are shown in detail in FIG. 10*d*. Integrated circuit 280 is a type 4017 integrated circuit. Pin 16 of integrated circuit 280 is connected to terminal 254, the 5 VCC power source. Pin 15 of integrated circuit 280 resets the internal counter of that integrated circuit. Referring to FIG. 10*f*, it may be seen that reset is triggered by the output of pin 7 of integrated circuit 320. In circuit 210, located in seconds circuit 206, reset 273 is connected to bus 282. In circuit 216, part of minutes circuit 207, reset 273 is connected to bus 283. In circuit 222, part of hours circuit 208, reset 273 is connected to bus 285.

Terminal 276 of FIG. 10*d* receives the clock pulse. In circuit 210, the clock pulse at terminal 276 is received from clock generator 204 through clock bus 272. However, in circuit 216, the clock pulse is received through bus 282, the reset bus of seconds circuit 206. In circuit 222, the clock pulse is received through bus 283, the reset bus of minutes circuit 207.

Pins 1–5, 7, 9, and 10 are each connected to an LED of LED array 296. The second connection to each LED of array 296 is connected to common lead 284. Common lead 284 is connected to other common leads 284 and to ground through the parallel circuit comprising resistor 292 and capacitor 294. Pins 13 and 8 of integrated circuit 280 are connected to ground. Pin 11 is connected through IN 4009 diodes 286 and 288 to terminal 276. Diode 288 is also connected to ground through 1000 ohm resistor 290. It should be noted that additional LED's could be installed in parallel with each LED of array 296 until the power limits of the integrated circuit are exceeded. Additional LED's provide additional light sources for each second, minute, or hour area making it possible to enlarge the timing areas and to smooth the light intensity in each timing area.

Figure 10E:
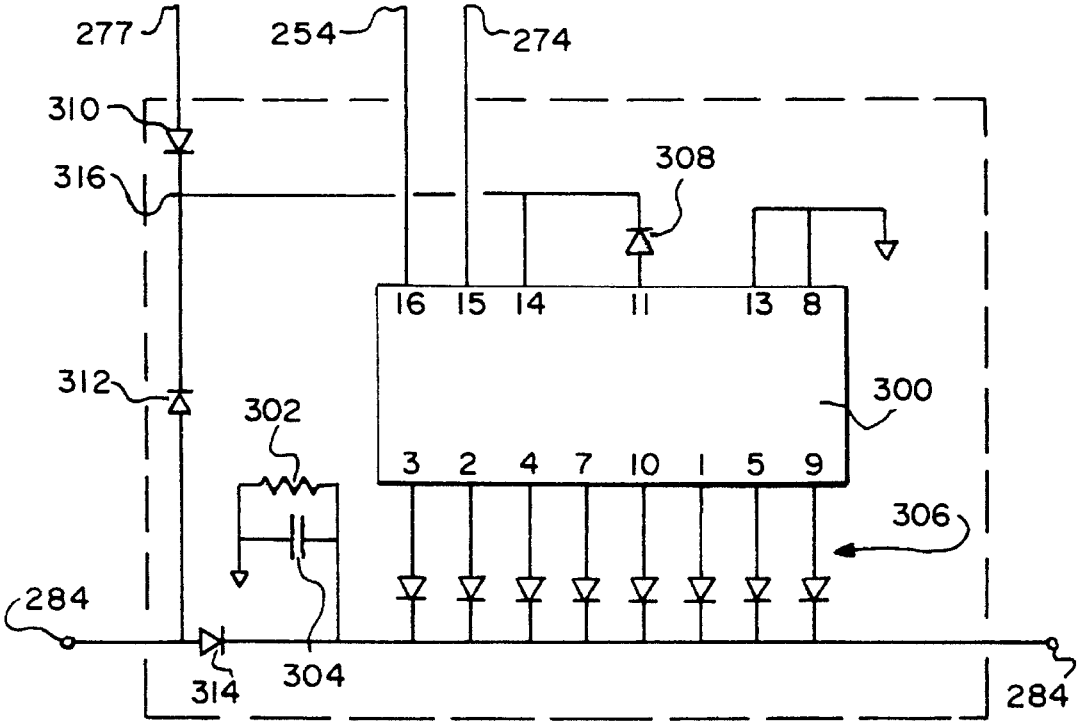
FIG. 10*e* is an electrical schematic diagram showing the main body of LED's being driven in blocks of eight by an integrated circuit.
Figure 10F:
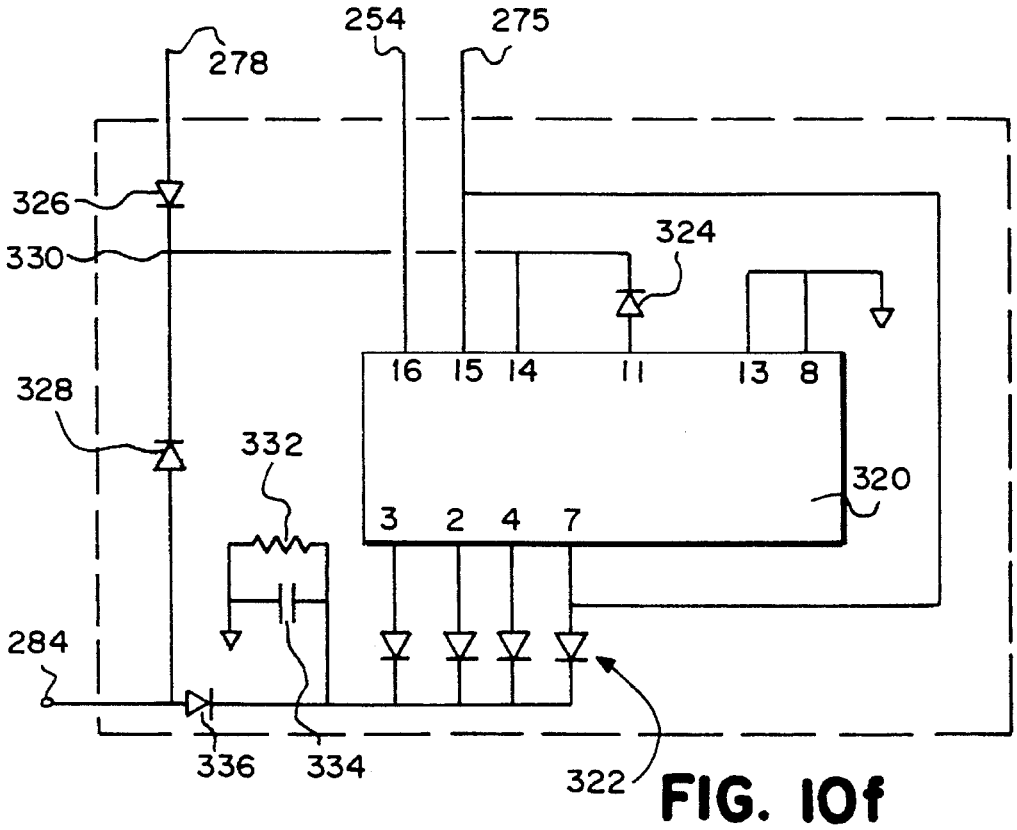
FIG. 10*f* is an electrical schematic diagram showing a block of four LED's being driven by an integrated circuit.

Circuits 212 and 218 of FIG. 9 are detailed in FIG. 10*e*. Integrated circuit 300 is a type 4017 integrated circuit. Pin 16 of IC 300 is connected to terminal 254, the 5 VCC power source. The connections of reset pin 15 of integrated circuit 300 depend on whether the circuit is located in seconds circuit 206 or in minutes circuit 208. When located in seconds circuit 206, reset 277 is connected to bus 282 but when located in minutes circuit 207, reset 277 is connected to bus 283. Pins 1–5, 7, 9, and 10 are each connected to an LED of LED array 306. The second connection to each LED of array 306 is connected to common lead 284. Common lead 284 is connected to other common leads 284, however, diode 314 is inserted to prevent current reversals. Common lead 284 is also connected to ground through the parallel circuit comprising resistor 302 and capacitor 304. Pins 13 and 8 of integrated circuit 280 are connected to ground. Pin 11 is connected through IN 4009 diode 308 to point 316. Point 316 is connected to common lead 284 through IN 4009 diode 312. Point 316 is also connected to terminal 277 through IN 4009 diode 310. Terminal 277 receives the clock pulses. When located in circuit 212, part of seconds circuit 206, the clock pulse is received by terminal 277 from clock generator 204 off the clock generator bus 272. However, when located in circuit 218, part of minutes circuit 207, clock pulses are received at terminal 277 from bus 282, the reset bus of seconds circuit 206.

The remaining LED's are driven by the circuit of FIG. 10*f*. FIG. 10*f* represents circuits 214, 220, and 224 of FIG. 9. In this circuit only four LED's are driven by the timing power circuit. Integrated circuit 320 is a type 4017 integrated circuit. Pin 16 of IC 320 is connected to terminal 254, the 5 VCC power source. The connections of reset pin 15 of integrated circuit 320 depend on whether the circuit is located in seconds circuit 206, minutes circuit 207, or hours circuit 208. When located in seconds circuit 206, reset 278 is connected to bus 282; when located in minutes circuit 207, reset 278 is connected to bus 283, and when located in hours circuit 208, reset 278 is connected to bus 285. Pins 2–4 and 7 are each connected to an LED of LED array 322. The second connection to each LED of array 322 is connected to common lead 284. Common lead 284 is connected to other common leads 284 through diode 336 and also to ground through the parallel circuit comprising resistor 332 and capacitor 334. Pins 13 and 8 of integrated circuit 320 are connected to ground. Pin 11 is connected through IN 4009 diodes 324 to point 330. Point 330 is connected to common lead 284 through IN 4009 diode 328. Point 330 is also connected to terminal 278 through IN 4009 diode 326. Terminal 278 receives the clock pulses. When located in circuit 214, part of seconds circuit 206, the clock pulse is received by terminal 278 from clock generator 204 off the clock generator bus 272. However, in circuit 220, located in minutes circuit 207, clock pulses are received at terminal 278 from bus 282, the reset bus of seconds circuit 206. When located in circuit 224, located in hours circuit 208, clock pulses are received at terminal 278 from bus 283, the reset bus of minutes circuit 206. The reset pulse originates when pin 7 of integrated circuit 320 is activated. The reset pulse is transmitted back to all circuits of seconds circuit 206, minutes circuit 207, and hours circuit 208, thus suddenly turning off all light emitting diodes in those respective circuits.

What is claimed is:

1. A display for depicting time comprising:

a. a first fillable area, said first area being circular having a diameter and, within said first area, a plurality of lightable chord segments positioned perpendicular to said diameter, said first area being linearly lightable by activating said chord segments progressively across said diameter;

b. a second fillable area; and c. a timing circuit and a power circuit electrically connected to progressively fill and clear said first fillable area and said second fillable area during a first time interval and a second time interval so that said second fillable area, during the passage of said first time interval progressively fills and then clears and said first fillable area, during the passage of said second time interval, progressively fills and then clears.

2. The display of claim 1 having a fillable seconds area electrically connected to the timing and power circuits so that during the passage of one minute said seconds area becomes filled and then clears.

3. The display of claim 1 wherein said timing and power circuits are electrically connected to progressively fill and clear said first and second fillable areas so that said first time interval is one hour and said second time interval is twelve hours.

4. The display of claim 1 wherein said timing and power circuits are electrically connected to progressively fill and clear said first and second fillable areas so that said first time interval is twelve hours and said second time interval is one hour.

5. The display of claim 3 wherein said timing and power circuits are electrically connected to progressively fill and clear said first and second fillable areas so that said first time interval is one hour and said second time interval is twenty four hours.

6. The display of claim 1 wherein said first and second fillable areas comprise an array of light emitting diodes.

7. The display of claim 1 wherein said first and second fillable areas are liquid crystal displays.

8. The display of claim 3 wherein said first and second fillable areas comprise an array of light emitting diodes.

9. A time display for depicting the passage of time comprising:

a. a first fillable area, said first area being circular and having a radius, said first area being lightable by progressive radial activation;

b. a second fillable area; and c. a timing and power circuit electrically connected to illuminate said first and second areas during a first time interval and a second time interval so that said second area, during the passage of said first time interval progressively becomes fully light actuated and then clears and said first area, during the passage of said second time interval, progressively, in a radial direction, becomes fully light actuated and then clears.

10. The time display of claim 9 further comprising a fillable seconds area, said seconds area permitting incremental and progressive light activation of said seconds area.

11. The display of claim 9 wherein said timing and power circuits are electrically connected to progressively fill and clear said first and second fillable areas so that said first time interval is one hour and said second time interval is twelve hours.

12. The display of claim 9 wherein said first and second fillable areas comprise an array of light emitting diodes.

13. The display of claim 11 wherein first and second fillable areas comprise an array of light emitting diodes.

14. The display of claim 9 wherein said first and second fillable areas are fiber optic bundles.

15. The display of claim 9 wherein said first and second fillable areas are discharge tubes.

16. The display of claim 9 wherein said first and second fillable areas are incandescent lights.

17. A simulated truck time display comprising:

a. a circular front wheel hours timing area, said front wheel timing area being progressively circumferentially lightable;

b. a body panel rectangular minutes timing area, said minutes timing area being linearly light actuable;

c. a rear tire ring seconds timing area, said seconds timing area having an outside circumference, and an inside circumference, said seconds timing area being positioned between said outside circumference and said inside circumference and being progressively horizontally linearly light actuated.

18. The time display of claim 17 further comprising a timing circuit and a power circuit electrically connected to said hours, minutes, and seconds timing areas so that during the passage of one minute, said seconds area progressively becomes light actuated and clears, and that during the passage of one hour, said minutes area progressively becomes light actuated and clears, and that during the passage of twelve hours, said hours area progressively becomes light actuated and clears.

19. The time display of claim 18 wherein said hours, minutes, and seconds timing areas comprise arrays of light emitting diodes.

20. The time display of claim 18 wherein said hours, minutes, and seconds timing areas comprise liquid crystal displays.

21. The time display of claim 18 wherein said hours, minutes, and seconds timing areas comprise bundles of fiber optic elements.

* * * * *